US010064510B1

(12) United States Patent
Yablon

(10) Patent No.: US 10,064,510 B1
(45) Date of Patent: Sep. 4, 2018

(54) WINE BOTTLE AND GLASS HOLDER

(71) Applicant: Jeffrey Yablon, New Holland, PA (US)

(72) Inventor: Jeffrey Yablon, New Holland, PA (US)

( * ) Notice: Subject to any disclaimer, the term of this patent is extended or adjusted under 35 U.S.C. 154(b) by 0 days.

(21) Appl. No.: 15/665,482

(22) Filed: Aug. 1, 2017

(51) Int. Cl.
*A47G 23/02* (2006.01)

(52) U.S. Cl.
CPC ..... *A47G 23/0208* (2013.01)

(58) Field of Classification Search
CPC ..... A47G 23/0208; A47G 23/02; A47G 23/0241; A47G 23/0641; A47G 19/065; A47G 19/06; A47B 73/00; A47B 13/16; A47F 7/28
USPC ..... 211/74
See application file for complete search history.

(56) References Cited

U.S. PATENT DOCUMENTS 616,013 A * 12/1898 Robertson ..... B65D 23/12 15/264
1,925,540 A * 9/1933 Neuschotz ..... A47G 23/0208 211/74
4,228,905 A * 10/1980 Cammarota ..... A47B 81/04 108/28
D273,446 S * 4/1984 Rankin ..... D6/514
4,546,883 A * 10/1985 Youngdale ..... B65D 81/05 206/216
4,700,849 A * 10/1987 Wagner ..... A47B 73/00 211/113
4,947,991 A * 8/1990 Snell ..... A47B 13/16 206/427
4,955,485 A * 9/1990 Alton ..... A47G 1/12 211/14
4,971,209 A * 11/1990 Todd ..... A47B 73/00 211/74
5,294,000 A * 3/1994 Yanuzzi ..... A47G 19/065 206/519
5,624,043 A * 4/1997 Baptista ..... A47G 23/0241 211/60.1
5,715,953 A * 2/1998 Brown ..... A47F 7/28 211/74
D393,388 S * 4/1998 Chen ..... D6/513
5,971,167 A * 10/1999 Finbow ..... A47G 23/0208 206/426
D419,402 S * 1/2000 Baker ..... D7/708
6,056,132 A * 5/2000 Becker ..... B25H 3/025 211/164
6,244,554 B1 6/2001 Baker
6,283,566 B1 * 9/2001 Doces ..... A47B 81/04 211/71.01
6,631,812 B2 * 10/2003 Ruiz ..... A47G 23/0208 211/113

(Continued)

FOREIGN PATENT DOCUMENTS

WO 2008089211 7/2008

*Primary Examiner* — Patrick D Hawn

(57) ABSTRACT

The wine bottle and glass holder is an apparatus that presents a bottle of wine and wine glasses in aesthetically pleasing way. It comprises a support bar that rests on the neck of an upright wine bottle and which supports a pair of inverted wine glasses suspended from the ends of the support bar. The wine bottle and glass holder may optionally comprise a marking area for displaying brand logos, advertising, or other textual or graphical information, one or more hooks for suspending items such as gifts, one or more storage wells for keeping items such as candles, and one or more chalkboard areas for writing temporary messages in chalk.

9 Claims, 5 Drawing Sheets

(56) References Cited

U.S. PATENT DOCUMENTS

| | | | | |
|---|---|---|---|---|
| 7,131,545 | B1 * | 11/2006 | Grogan | A47G 23/0208 211/85.29 |
| D614,926 | S * | 5/2010 | Cox | D7/708 |
| 7,878,812 | B2 * | 2/2011 | Krongard | A47B 97/04 434/408 |
| 7,984,813 | B1 | 7/2011 | Tapager | |
| 8,186,538 | B2 | 5/2012 | MacCarthy | |
| 8,590,715 | B2 * | 11/2013 | Gray | A47G 23/0208 211/181.1 |
| 8,672,175 | B2 | 3/2014 | Farmer | |
| D717,132 | S | 11/2014 | Van Dyke | |
| 9,220,337 | B1 * | 12/2015 | Wenzel | A47B 13/021 |
| 9,522,560 | B2 * | 12/2016 | Paulick | B42F 9/001 |
| D789,756 | S * | 6/2017 | MacDonald | D7/701 |
| 9,839,311 | B2 * | 12/2017 | Shames | A47G 23/0641 |
| 2005/0017134 | A1 * | 1/2005 | Hooper | A47G 23/0208 248/103 |
| 2005/0263464 | A1 * | 12/2005 | Nunn | A47G 23/0208 211/74 |
| 2006/0255050 | A1 * | 11/2006 | MacCarthy | A47G 19/065 220/737 |
| 2006/0261075 | A1 * | 11/2006 | MacCarthy | A47G 19/065 220/737 |
| 2008/0264822 | A1 | 10/2008 | Faiola | |
| 2010/0209662 | A1 | 8/2010 | Slade | |

* cited by examiner

WINE BOTTLE AND GLASS HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wine accessories, more specifically, a holder for a bottle of wine and wine glasses.

SUMMARY OF INVENTION

The wine bottle and glass holder is an apparatus that presents a bottle of wine and wine glasses in aesthetically pleasing way. It comprises a support bar that rests on the neck of an upright wine bottle and which supports a pair of inverted wine glasses suspended from the ends of the support bar. The wine bottle and glass holder may optionally comprise a marking area for displaying brand logos, advertising, or other textual or graphical information, one or more hooks for suspending items such as gifts, one or more storage wells for keeping items such as candles, and one or more chalkboard areas for writing temporary messages in chalk.

An object of the invention is to present a bottle of wine and two wine glasses in an aesthetically pleasing manner.

Another object of the invention is to provide storage areas for candles, jewelry, photographs, mints, and other items.

Yet another object of the invention is to provide one or more areas for writing a temporary message.

A further object of the invention is to provide one or more areas that can be printed or otherwise marked to show logos, advertisements, or other textual or graphical information.

These together with additional objects, features and advantages of the wine bottle and glass holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the wine bottle and glass holder in detail, it is to be understood that the wine bottle and glass holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wine bottle and glass holder.

It is therefore important that the claims be regarded as including such equivalent construction insofar as they do not depart from the spirit and scope of the wine bottle and glass holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
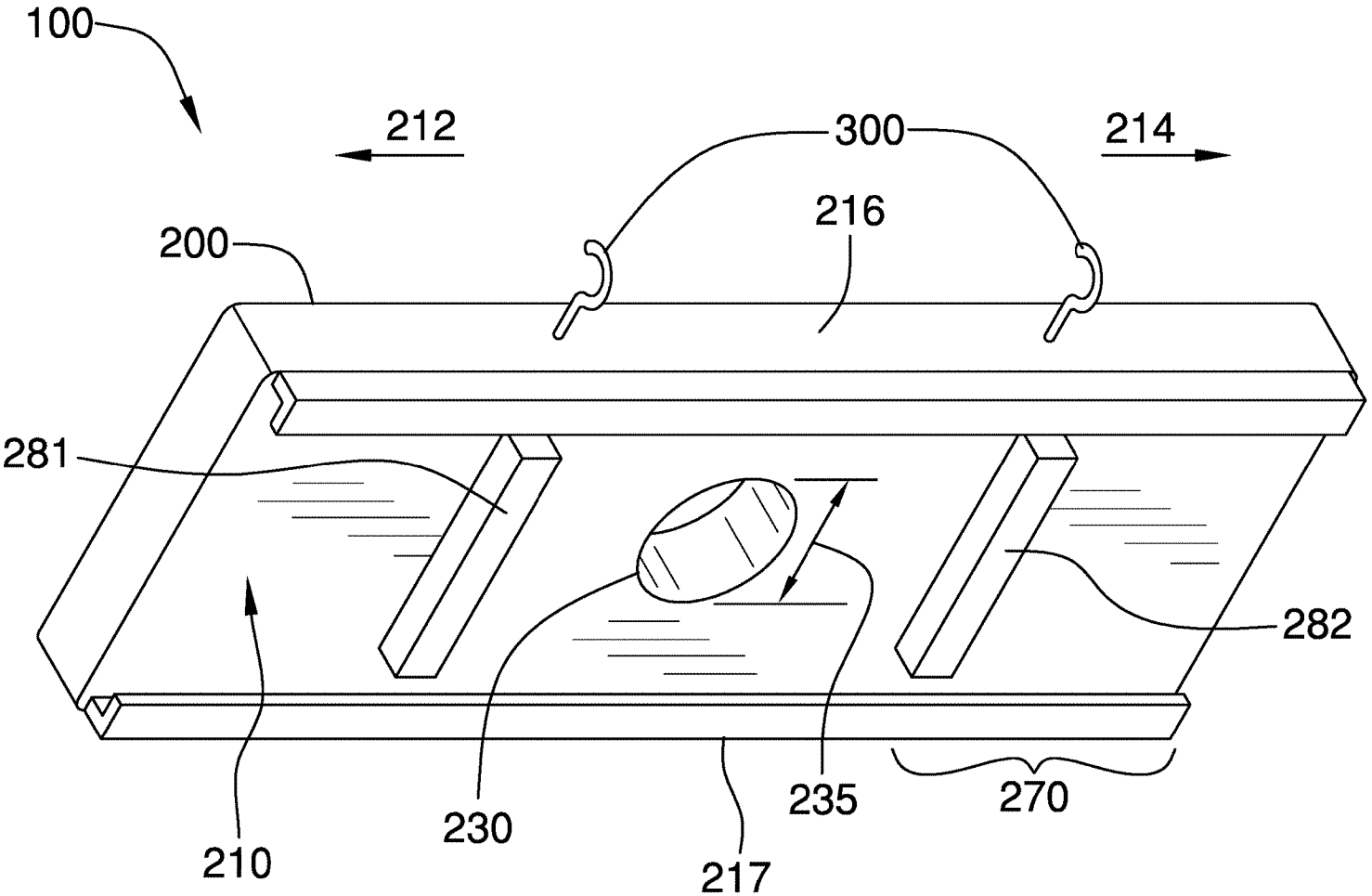
FIG. 1 is a perspective view of an embodiment of the disclosure as seen from below.
Figure 2:
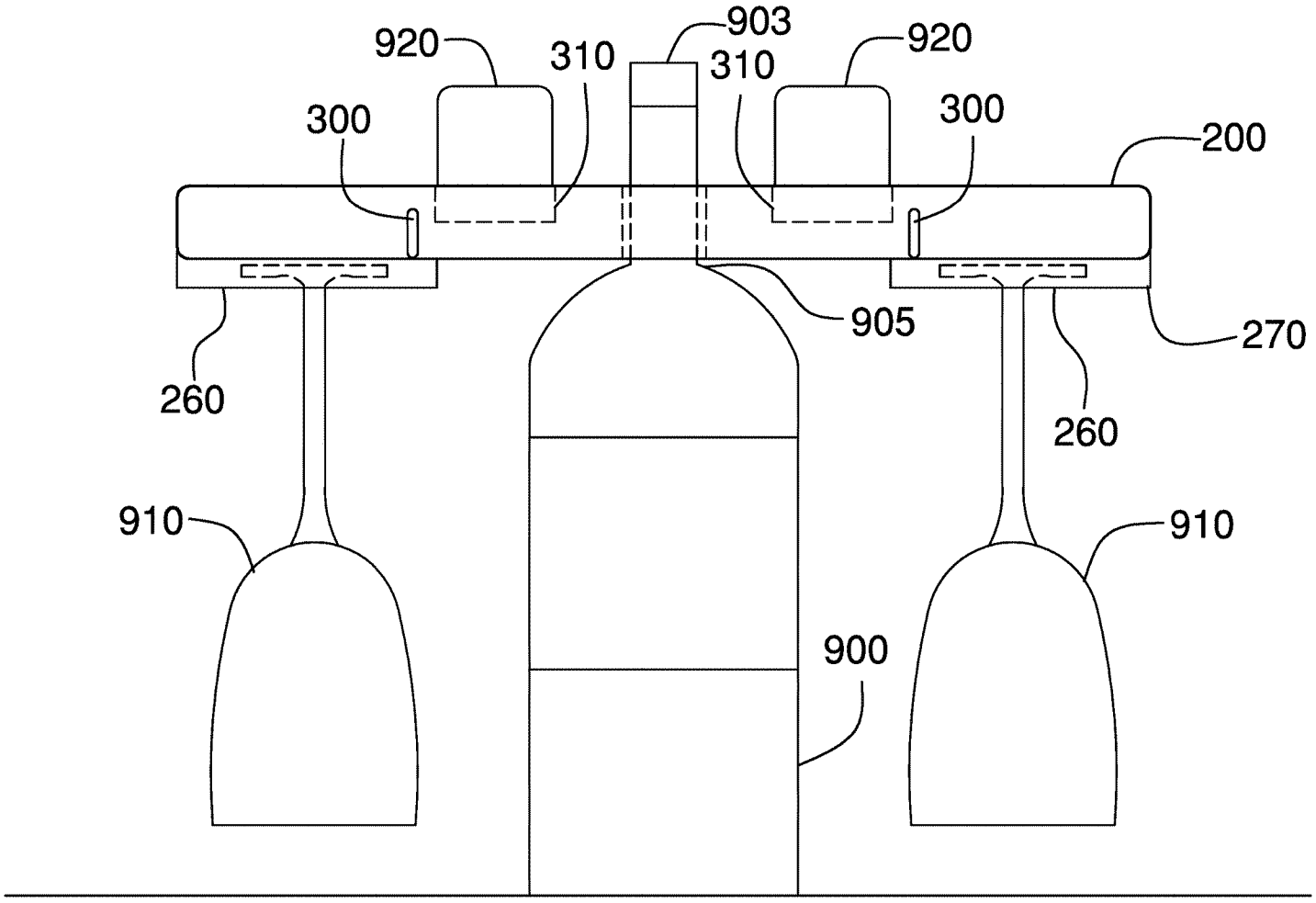
FIG. 2 is a front side view of an embodiment of the disclosure being used.
Figure 3:
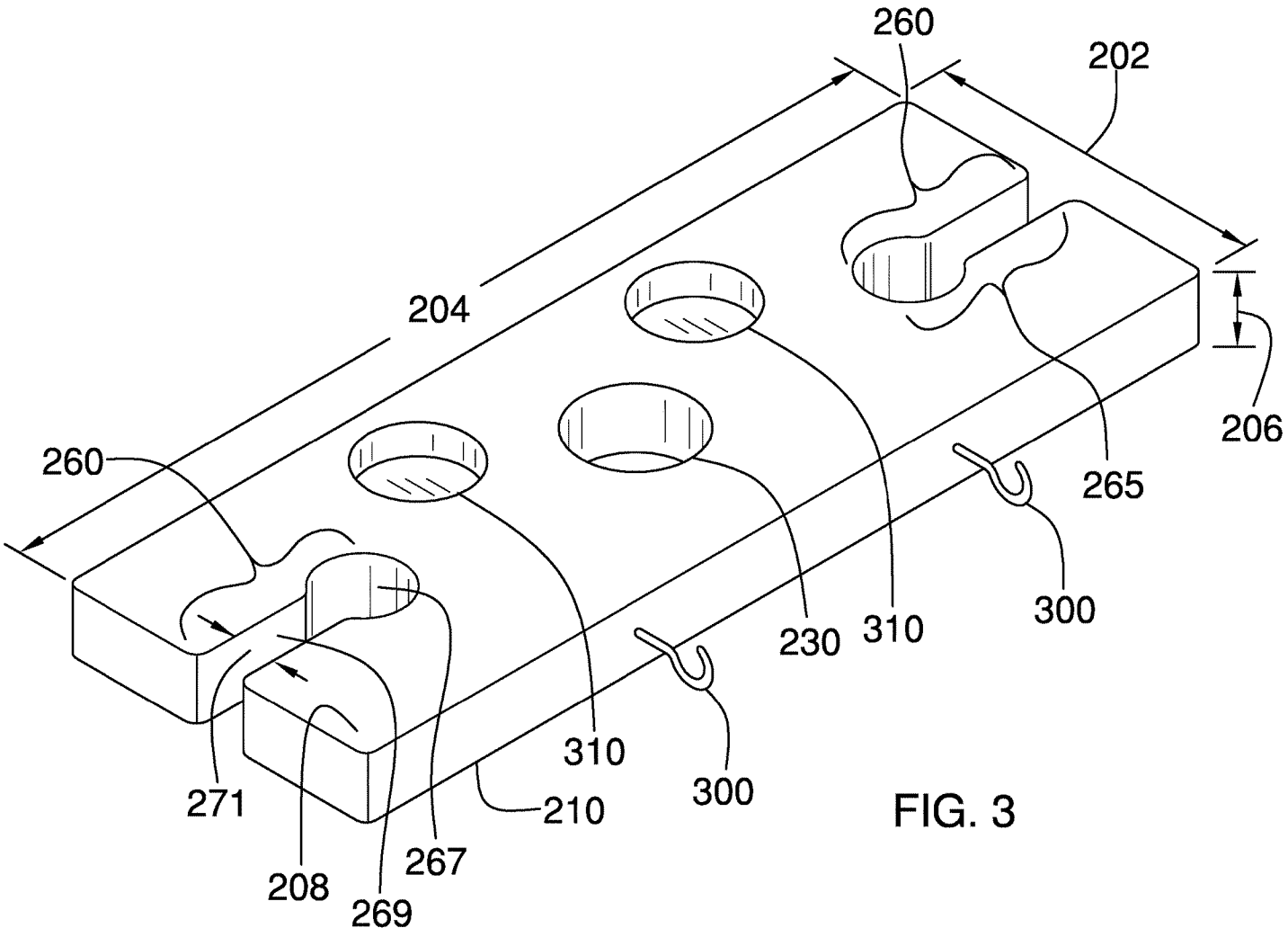
FIG. 3 is a perspective view of a second embodiment of the disclosure as seen from above.
Figure 4:
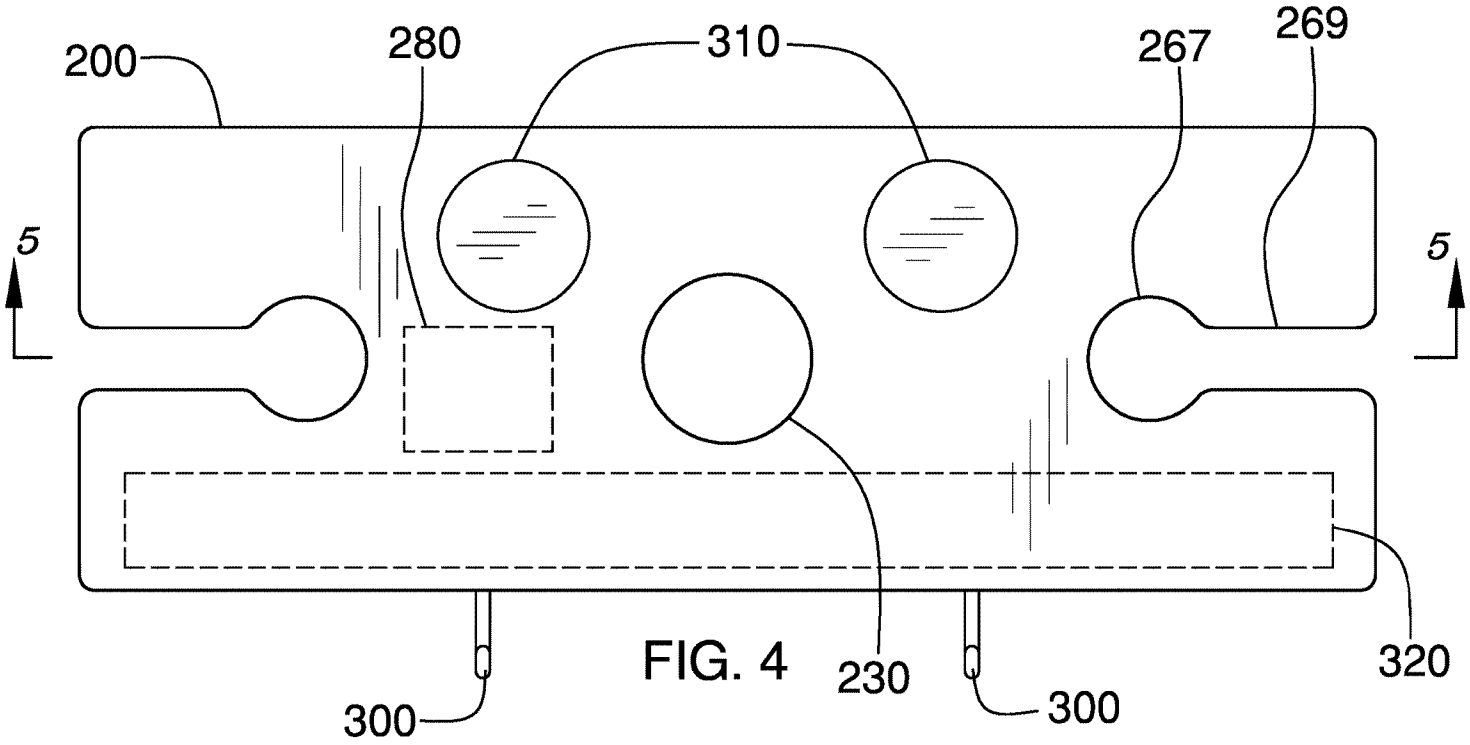
FIG. 4 is a top view of a second embodiment of the disclosure.
Figure 5:
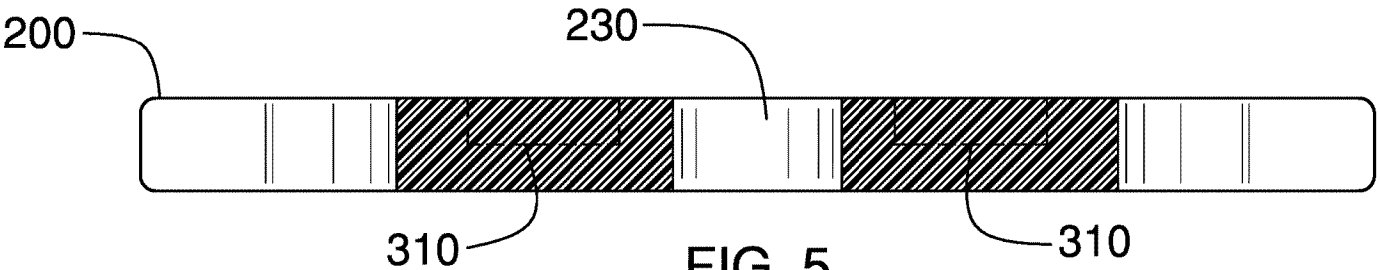
FIG. 5 is a cross-sectional view of a second embodiment of the disclosure across 5-5 as shown in FIG. 4.
Figure 6:
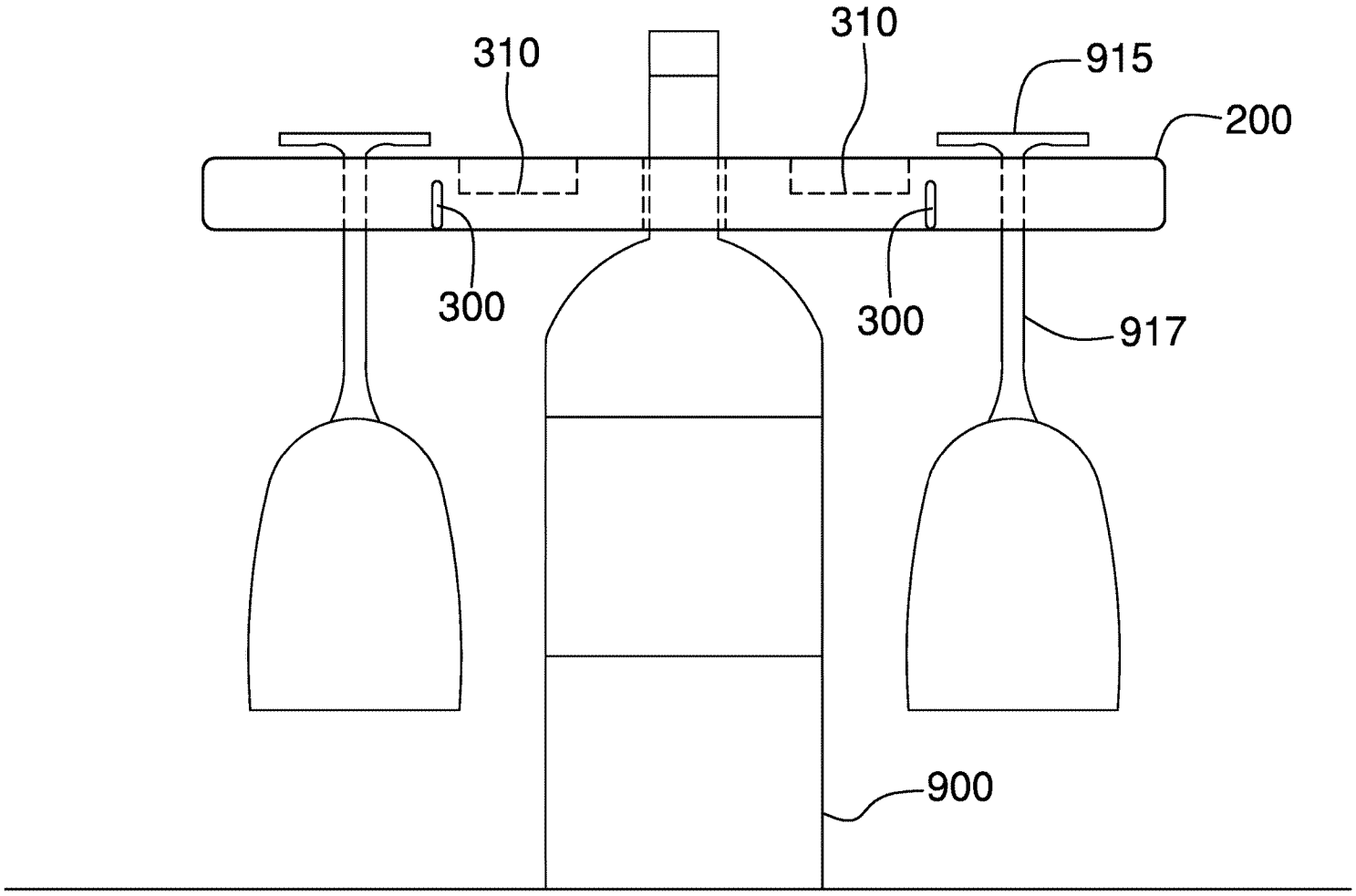
FIG. 6 is a front view of a second embodiment of the disclosure being used.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 6.

The wine bottle and glass holder 100 (hereinafter invention) comprises a support bar 200, a wine bottle hole 230 and two wine glass holders 260. The support bar 200 rests on a neck 905 of a wine bottle 900 with the neck 905 passing up through the wine bottle hole 230. An empty wine glass 910 may be suspended from each of the two wine glass holders 260. The invention 100 provides an aesthetically pleasing way to present the wine bottle 900 and the empty wine glasses 910.

The support bar 200 may be a rectangular support for two of the empty wine glasses 910. A support bar width 202 may be greater than or equal to the diameter of a base of the wine glass 915. A support bar length 204 may be greater than or equal to the sum of two times the diameter of the base of the wine glass 915 plus a wine bottle diameter 901. A support bar height 206 is not critical, but the support bar 200 simply needs to be thick enough to not sag under the weight of the empty wine glasses 910.

The material used to construct the support bar 200 is not critical. As non-limiting examples, the invention 100 may be fabricated from various types of wood, plastic, or metal.

The wine bottle hole 230 is centrally located on the support bar 200 and passes from a top surface 208 of the support bar 200 to a bottom surface 210 of the support bar 200. A wine bottle hole diameter 235 is at least as large as the diameter of a top 903 of the wine bottle 900 and is smaller than the wine bottle diameter 901. The wine bottle hole 230 may be contoured. As a non-limiting example, the wine bottle hole 230 may be tapered to match the shape of the neck 905 of the wine bottle 900 to give the support bar 200 more stability on the wine bottle 900.

The two wine glass holders 260 are located at the ends of the support bar 200. Specifically, one of the two wine glass holders 260 is located on a left end 212 of the support bar 200 and one of the two wine glass holders 260 is located on a right end 214 of the support bar 200.

In some embodiments, each of the two wine glass holders 260 may comprise a wine glass base clip 270. The wine glass base clip 270 is an L-shaped retention clip coupled to the bottom surface 210 of the support bar 200, one on the entire span of a first edge 216 of the support bar 200 and one on the entire span of a second edge 217 of the support bar 200. Each of the wine glass base clips 270 may be oriented with the open end of the L positioned towards the end of the support bar 200 and away from the wine bottle hole 230. Each of the wine glass base clips 270 is narrower closer to the support bar 200 than a maximum width of the clip 264, thus forming an overhang inside of the L U. The overhang is for grasping the base of the wine glass 915. In use, the empty wine glass 910 is inverted and placed under the support bar 200 beyond the left end 212, or the right end 214, of the support bar 200. Then the base of the wine glass 915 is slid into the wine glass base clip 270. This is done twice, once on the left end 212 of the support bar 200 and once on the right end 214 of the support bar 200.

As shown most clearly in FIG. 1, when a wine glass base clip 270 is used, the bottom surface 210 of the support bar 200 further comprises a first wine glass stop 281 and a second wine glass stop 282. The first wine glass stop 281 is a rectangular block structure. The second wine glass stop 282 is a rectangular block structure. The dimensions of the first wine glass stop 281 are identical to the dimensions of the second wine glass stop 282. The first wine glass stop 281 and the second wine glass stop 282 form a barrier that prevents a wine glass 910 from being inserted so deeply into the wine glass base clip 270 that the wine glass 910 will come in contact with a wine bottle 900 stored in the wine bottle hole 230.

In some embodiments, each of the two wine glass holders 260 may comprise a wine stem notch 265. The wine stem notch 265 comprises a stem hole 267 and a stem channel 269. The stem hole 267 is a hole drilled through the support bar 200 at a position between the wine bottle hole 230 and the left end 212, or the right end 214, of the support bar 200. The diameter of the stem hole 267 is larger than the diameter of a stem of the wine glass 917 and smaller than the diameter of the base of the wine glass 915. The stem channel 269 is a cutout portion of the support bar 200 from the stem hole 267 to the left end 212 of the support bar 200 or to the right end 214 of the support bar 200, whichever is closer. A width of stem channel 271 is larger than the diameter of the stem of the wine glass 917 and smaller than the width of the stem hole 267.

In use, the empty wine glass 910 is inverted and placed next to the left end 212, or the right end 214, of the support bar 200 with the base of the wine glass 915 above the top surface 208 of the support bar 200 and with the stem of the wine glass 917 aligned with the stem channel 269. The empty wine glass 910 may then be moved towards the wine bottle hole 230 and lowered onto the support bar 200. This is done twice, once on the left end 212 of the support bar 200 and once on the right end 214 of the support bar 200.

In some embodiments, the support bar 200 may comprise one or more marking areas 280 where the support bar 200 may be imprinted, embossed, burned, or otherwise marked with information. As a non-limiting example, the information may be textual or graphical in nature and may comprise branding information, logos, advertisements, or other information. As a further non-limiting example, the invention 100 may be used by corporations, sports teams, financial institutions, and other entities as a promotional item, meaning that the invention 100 may be given away by the entity at no or little cost as a form of advertisement with promotional messages or logos in the one or more marking areas 280.

The invention 100 may further comprise one or more hooks 300. The one or more hooks 300 may be placed on the first edge 216 of the support bar 200 and may be used to suspend one or more items from the support bar 200. As a non-limiting example, the one or more hooks 300 may be used to suspend jewelry, photos, message cards, or other items.

The invention 100 may further comprise one or more storage wells 310. The one or more storage wells 310 may be areas of the top surface 208 of the support bar 200 that are drilled to a depth less than the support bar height 206. As a non-limiting example, the one or more storage wells 310 may be used to hold candles 920, mints, photos or other items.

The invention 100 may further comprise one or more chalkboard areas 320. The one or more chalkboard areas 320 may be areas of the top surface 208 of the support bar 200 where chalkboard paint or a similar finish has been applied to allow temporary messages to be written using a piece of chalk and then erased and rewritten.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A wine bottle and glass holder comprising:

a support bar, a wine bottle hole, and two wine glass holders;

wherein the support bar rests on a neck of a wine bottle with the neck passing up through the wine bottle hole;

wherein an empty wine glass is suspended from each of the two wine glass holders;

wherein the wine bottle and glass holder provides a way to present the wine bottle and the empty wine glasses;

wherein the support bar is a rectangular support for two of the empty wine glasses;

wherein a support bar width is greater than or equal to the diameter of a base of the wine glass;

wherein a support bar length is greater than or equal to the sum of two times the diameter of the base of the wine glass plus a wine bottle diameter;

wherein the wine bottle hole is centrally located on the support bar and passes from a top surface of the support bar to a bottom surface of the support bar;

wherein a wine bottle hole diameter is at least as large as the diameter of a top of the wine bottle and is smaller than the wine bottle diameter;

wherein the wine bottle hole is contoured to match the shape of the neck of the wine bottle to give the support bar more stability on the wine bottle;

wherein one of the two wine glass holders is located on a left end of the support bar;

wherein the other of the two wine glass holders is located on a right end of the support bar;

wherein the wine bottle and glass holder comprises one or more chalkboard areas;

wherein the one or more chalkboard areas are areas of the top surface of the support bar where chalkboard paint has been applied to allow messages to be written using a piece of chalk;

wherein the support bar comprises one or more marking areas where the support bar is marked with information;

wherein the wine bottle and glass holder comprises one or more hooks;

wherein the one or more hooks are placed on an edge of the support bar and are used to suspend one or more items from the support bar;

wherein the wine bottle and glass holder comprises one or more storage wells;

wherein the one or more storage wells are areas of the top surface of the support bar that are drilled to a depth less than a support bar height.

2. The wine bottle and glass holder according to claim 1 wherein each of the two wine glass holders comprise a wine glass base clip;

wherein the wine glass base clip is an L-shaped retention clip coupled to the bottom surface of the support bar;

wherein the wine glass base clip further comprises a first wine glass stop and a second wine glass stop;

wherein the first wine glass stop limits the motion of the wine glass within the wine glass base clip;

wherein the second wine glass stop limits the motion of the wine glass within the wine glass base clip.

3. The wine bottle and glass holder according to claim 2 wherein each of the wine glass base clips is oriented with the open end of the L positioned towards the end of the support bar and away from the wine bottle hole.

4. The wine bottle and glass holder according to claim 3 wherein each of the wine glass base clips is narrower closer to the support bar than a maximum width of the clip thus forming an overhang for grasping the base of the wine glass.

5. The wine bottle and glass holder according to claim 1 wherein each of the two wine glass holders comprise a wine stem notch;

wherein the wine stem notch comprises a stem hole and a stem channel.

6. The wine bottle and glass holder according to claim 5 wherein the stem hole is a hole drilled into the support bar at a position between the wine bottle hole and either the left end of the support bar or the right end of the support bar.

7. The wine bottle and glass holder according to claim 6 wherein the diameter of the stem hole is larger than the diameter of a stem of the wine glass and smaller than the diameter of the base of the wine glass.

8. The wine bottle and glass holder according to claim 7 wherein the stem channel is a cutout of the support bar from the stem hole to either the left end of the support bar or the right end of the support bar, whichever is closer.

9. The wine bottle and glass holder according to claim 8 wherein a width of stem channel is larger than the diameter of the stem of the wine glass and smaller than the width of the stem hole.

* * * * *